US009507297B2

(12) United States Patent
Matsushima et al.

(10) Patent No.: US 9,507,297 B2
(45) Date of Patent: Nov. 29, 2016

(54) TUBULAR BODY, TUBULAR BODY UNIT, AND INTERMEDIATE TRANSFER BODY FOR IMAGE FORMING APPARATUS, IMAGE FORMING APPARATUS, AND METHOD FOR MANUFACTURING TUBULAR BODY

(71) Applicant: FUJI XEROX CO., LTD., Tokyo (JP)

(72) Inventors: Tomoo Matsushima, Kanagawa (JP); Satoshi Mizoguchi, Kanagawa (JP); Tomotake Inagaki, Kanagawa (JP); Fumio Daishi, Kanagawa (JP); Kenji Omori, Kanagawa (JP); Koichi Matsumoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/814,657

(22) Filed: Jul. 31, 2015

(65) Prior Publication Data

US 2016/0209780 A1 Jul. 21, 2016

(30) Foreign Application Priority Data

Jan. 16, 2015 (JP) ..... 2015-006552

(51) Int. Cl.
*G03G 15/16* (2006.01)

(52) U.S. Cl.
CPC ..... *G03G 15/162* (2013.01)

(58) Field of Classification Search
CPC ..... G03G 15/162; G03G 15/1685; G03G 2215/00957; G03G 15/75; G03G 2215/00151
See application file for complete search history.

(56) References Cited

U.S. PATENT DOCUMENTS

| | | | | |
|---|---|---|---|---|
| 2006/0172097 | A1* | 8/2006 | Morikoshi | G03G 5/10 428/35.7 |
| 2010/0144505 | A1* | 6/2010 | Kim | G03G 15/0233 492/18 |
| 2012/0243916 | A1* | 9/2012 | Oomori | G03G 15/162 399/302 |
| 2014/0183420 | A1 | 7/2014 | Kamoi et al. | |

FOREIGN PATENT DOCUMENTS

| | | |
|---|---|---|
| JP | 2003-233176 A | 8/2003 |
| JP | 2014-130215 A | 7/2014 |

* cited by examiner

*Primary Examiner* — Sandra Brase
(74) *Attorney, Agent, or Firm* — Sughrue Mion, PLLC

(57) ABSTRACT

A tubular body for an image forming apparatus is formed by subjecting a tubular member containing a thermoplastic resin to thermal processing. The thermal processing is performed so that at least one edge of the tubular member is thermally melted and then cured in at least a portion of the edge in a peripheral direction.

15 Claims, 2 Drawing Sheets

TUBULAR BODY, TUBULAR BODY UNIT, AND INTERMEDIATE TRANSFER BODY FOR IMAGE FORMING APPARATUS, IMAGE FORMING APPARATUS, AND METHOD FOR MANUFACTURING TUBULAR BODY

CROSS-REFERENCE TO RELATED APPLICATIONS

This application is based on and claims priority under 35 USC 119 from Japanese Patent Application No. 2015-006552 filed Jan. 16, 2015.

BACKGROUND

Technical Field

The present invention relates to a tubular body, a tubular body unit, and an intermediate transfer body for an image forming apparatus, the image forming apparatus, and a method for manufacturing the tubular body.

SUMMARY

According to an aspect of the invention, there is provided a tubular body for an image forming apparatus, the tubular body being formed by subjecting a tubular member containing a thermoplastic resin to thermal processing. The thermal processing is performed so that at least one edge of the tubular member is thermally melted and then cured in at least a portion of the edge in a peripheral direction.

BRIEF DESCRIPTION OF THE DRAWINGS

An exemplary embodiment of the present invention will be described in detail based on the following figures, wherein.

DETAILED DESCRIPTION

Figure 1:
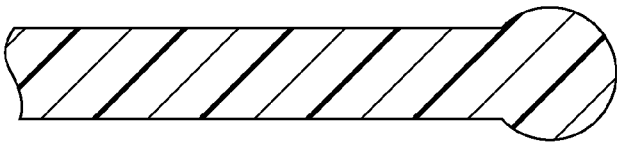
FIG. 1 is a schematic sectional view of an example of a tubular body according to an exemplary embodiment.

An exemplary embodiment of the present invention will now be described. The exemplary embodiment and examples merely exemplify the present invention and do not limit the scope of the present invention.

In the exemplary embodiment of the present invention, the term "step" refers not only to an independent step but also to a step that cannot be clearly distinguished from other steps as long as a certain effect is obtained.

Tubular Body

A tubular body according to the present exemplary embodiment is installed in an image forming apparatus.

The tubular body according to the present exemplary embodiment is formed by subjecting a tubular member containing a thermoplastic resin to thermal processing. More specifically, at least one edge of the tubular member is thermally melted and then cured in at least a portion of the edge in a peripheral direction.

In the present exemplary embodiment, the term "edges" of the tubular body or the tubular member refers to portions that connect the inner and outer surfaces of the tubular body or the tubular member at both ends in a width direction of the tubular body or the tubular member.

In the present exemplary embodiment, the term "width direction" of the tubular body or the tubular member means a direction parallel to the direction of a rotational axis around which the tubular body rotates in an image forming operation.

A known tubular body used as, for example, an intermediate transfer belt of an image forming apparatus is formed by cutting a tubular member into a desired width after the tubular member is manufactured by, for example, extrusion molding, injection molding, or application. However, when the tubular body manufactured in this way is installed in an image forming apparatus and an image forming operation is repeatedly performed, there is a risk that cracks will be formed in end portions of the tubular body in the width direction. The cracks formed in the end portions in the width direction may eventually lead to a breakage of the tubular body.

The cracks are probably formed because, for example, projections, splits, cuts, steps in the peripheral direction, steps in the thickness direction, etc. (hereinafter generically referred to as "irregular portions") are formed in cut portions of the tubular member when the tubular member is cut. When the irregular portions are formed in the cut portions of the tubular member, the tubular body has the irregular portions at the edges thereof. Therefore, when the tubular body is installed in the image forming apparatus and an image forming operation is repeated, stress concentration occurs in the irregular portions. As a result, cracks that extend from the irregular portions are formed in the end portions of the tubular body in the width direction. As countermeasures, the irregular portions may be smoothed by polishing the cut portions after the cutting process, or reinforcing tape may be applied to the end portions of the tubular body in the width direction. However, also in such a case, when the image forming operation is repeated, there is a risk that cracks will be formed.

Accordingly, in the tubular body according to the present exemplary embodiment, at least one edge of the tubular member, from which the tubular body is formed and which contains the thermoplastic resin, is thermally melted and then cured, so that the shape of the irregular portions is changed to a smooth shape. As a result, the risk that the cracks will be formed in the end portions of the tubular body in the width direction is reduced.

Moreover, the edges of the tubular body according to the present exemplary embodiment are formed in a bulging shape by being thermally melted and then cured. Therefore, it is assumed that the dynamic strength of the edge portions of the tubular body in the width direction is higher than that in the case where the edges do not have a bulging shape. This is probably another factor that contributes to suppressing the formation of cracks in the end portions of the tubular body in the width direction.

FIG. 1 is a schematic sectional view of an example of the tubular body according to the present exemplary embodiment. FIG. 1 is a sectional view of an end portion of the tubular body in the width direction taken along a plane extending in the width direction and the thickness direction.

At least one edge of the tubular body according to the present exemplary embodiment has a bulging shape illustrated in FIG. 1, that is, a circular shape in cross section so as to project outward from the outer surface and the inner surface of the tubular body, at least in a portion of the edge in a peripheral direction.

The edge having the bulging shape is formed when the tubular member, from which the tubular body according to the present exemplary embodiment is formed and which contains the thermoplastic resin, is subjected to thermal processing. In other words, since the edge of the tubular member containing the thermoplastic resin is thermally melted and then cured, the edge of the tubular body according to the present exemplary embodiment has the bulging shape.

In the tubular body according to the present exemplary embodiment, from the viewpoint of increasing the manufacturing efficiency and further suppressing the formation of cracks, both edges of the tubular member containing the thermoplastic resin are desirably subjected to thermal processing over the entire regions of the edges in the peripheral direction. Therefore, in the present exemplary embodiment, both edges of the tubular member may have the bulging shape over the entire regions of the edges in the peripheral direction.

The tubular body according to the present exemplary embodiment may be a belt-shaped member or a roll-shaped member included in an image forming apparatus. More specifically, the tubular body may be used as an intermediate transfer belt, a recording-medium transport belt, a fixing belt, or the like. The tubular body according to the present exemplary embodiment may have a single-layer structure or a multiple-layer structure (for example, a structure in which a release layer is provided on the surface).

In the case where the tubular body according to the present exemplary embodiment is used as an intermediate transfer body, the thickness of the tubular body may be in the range of 30 μm or more and 200 μm or less.

The materials of the tubular body according to the present exemplary embodiment and the tubular member from which the tubular body is formed will now be described.

Thermoplastic Resin

The thermoplastic resin may be, for example, polyphenylene sulfide (PPS), polyamide (PA), polyether imide (PEI), polyether ether ketone (PEEK), polyether sulfone (PES), polyphenyl sulfone (PPSU), polysulfone (PSF), polyethylene terephthalate (PET), polybutylene terephthalate (PBT), polyacetal (POM), or polycarbonate (PC). The thermoplastic resin may be a single type of material or a combination of two or more types of materials.

From the viewpoint of formability, the melting temperature of the thermoplastic resin is desirably in the range of, for example, 200° C. or more and 400° C. or less.

Conducting Agent

The tubular body according to the present exemplary embodiment may further contain a conducting agent depending on the use of the tubular body in the image forming apparatus. In the case where the tubular body according to the present exemplary embodiment is used as an intermediate transfer body, the tubular body preferably contains a conducting agent. The conducting agent is a material added to impart a desired conductivity.

The conducting agent may be, for example, a carbon black; a metal such as aluminum or nickel; a metal oxide such as yttrium oxide or tin oxide; an ion conductive material such as potassium titanate or potassium chloride; or a conductive polymer such as polyaniline, polypyrrole, polysulfone, or polyacethylene. In particular, a carbon black may be used.

The conducting agent may be a single type of material or a combination of two or more types of materials.

The carbon black may be, for example, Ketjenblack, oil-furnace black, channel black, or acetylene black.

The average primary particle size of the carbon black used as the conducting agent may be in the range of, for example, 10 nm or more and 40 nm or less.

The content of the conducting agent differs depending on the type of the conducting agent. When a carbon black is used as the conducting agent, the content may be in the range of, for example, 5 parts by mass or more and 40 parts by mass or less for 100 parts by mass of the thermoplastic resin. From the viewpoint of imparting the conductivity required when the tubular body is used as the intermediate transfer body, the content of the carbon black is desirably 8 parts by mass or more. From the viewpoint of suppressing breakage of the tubular body or formation of cracks in the end portions of the tubular body, the content of the carbon black is desirably 30 parts by mass or less.

Other Additives

Other additives may include additives that are commonly added to the material of an endless belt of an image forming apparatus, such as antioxidant, a heat resistant material, a release agent, a cross linking agent, a coloring agent, and a surface-active agent.

Method for Manufacturing Tubular Body

There is no particular limitation regarding the method for manufacturing the tubular body according to the present exemplary embodiment. However, the method may include at least a first step of preparing a tubular member containing a thermoplastic resin, a second step of thermally melting at least one edge of the tubular member in at least a portion of the edge in a peripheral direction, and a third step of curing the melted edge of the tubular member.

The tubular member prepared in the first step may be, for example, an extrusion molded part formed by melting a resin composition containing a thermoplastic resin, extruding the resin composition from a die into a tubular shape, and curing the resin composition; an injection molded part formed by melting a resin composition containing a thermoplastic resin, injecting the resin composition into a tubular mold, and curing the resin composition; or a part formed by applying a liquid composition containing a thermoplastic resin to a core, drying the liquid composition, and removing the core after a burning process.

The tubular member formed of the extrusion molded part, the injection molded part, or the part formed by the application process may be manufactured one at a time, or by manufacturing a part that is long in the axial direction and cutting the part into a desired length. The part may be cut into the desired length by using, for example, a cutter having a metal cutting edge, a pair of scissors, or the like.

The tubular member formed of the extrusion molded part, the injection molded part, or the part formed by the application process may have an irregular portion formed on an edge of the tubular member in the cutting process. However, since the second and third steps are performed, the irregular portion on the edge of the tubular member may be changed to a smooth bulging portion.

The tubular member formed of the extrusion molded part, the injection molded part, or the part formed by the application process includes a part that is thermally cut by irradiating the part with a laser beam or ultrasonic waves. Even when the part is thermally cut, a step in the peripheral direction is formed on an edge of the part when the cutting end point is displaced from the cutting start point. In this case, a region around the cutting end point may be irradiated with the laser beam or ultrasonic waves longer than the period required for the purpose of cutting, so that the step in the peripheral direction is thermally melted. Then, the melted portion may be cured so that the shape of the edge is changed to a continuous shape. In this case, the second step is carried out together with the first step.

The tubular member prepared in the first step may contain a conducting agent depending on the use of the tubular body in the image forming apparatus. The tubular member containing the conducting agent may be prepared by adding the conducting agent to the resin composition or the liquid composition used to form the extrusion molded part, the injection molded part, or the part formed by the application process.

The second step is performed by, for example, pressing at least one edge of the tubular member against a heat source (for example, a hot plate) that is heated to a temperature higher than or equal to the melting temperature of the thermoplastic resin contained in the tubular member. Alternatively, the second step may be performed by irradiating at least one edge of the tubular member with a laser beam or ultrasonic waves so that heat is generated.

In the second step, the edge of the tubular member is pressed against the heat source or irradiated with the laser beam or ultrasonic waves at least in a region where the irregular portion is present. From the viewpoint of increasing the manufacturing efficiency and further suppressing the formation of cracks, both edges of the tubular member are desirably pressed against the heat source or irradiated with the laser beam or ultrasonic waves over the entire regions of the edges in the peripheral direction.

The third step is performed by, for example, placing the tubular member, which has an edge thermally melted in the second step, in an environment at a temperature lower than the melting temperature of the thermoplastic resin or in a water tank so that the tubular member is cooled. As a result of the third step, the edge of the tubular member that has been thermally melted is cured. The edge that has been thermally melted and then cured has a smooth shape. Normally, the edge has a bulging shape as illustrated in FIG. 1.

A tubular body unit, an intermediate transfer body, and an image forming apparatus in which the tubular body according to the present exemplary embodiment is included will now be described.

Tubular Body Unit

The tubular body unit according to the present exemplary embodiment includes the tubular body according to the present exemplary embodiment and plural rollers around which the tubular body extends with a tension applied to the tubular body. The tubular body unit is detachably attachable to the image forming apparatus.

Figure 2:
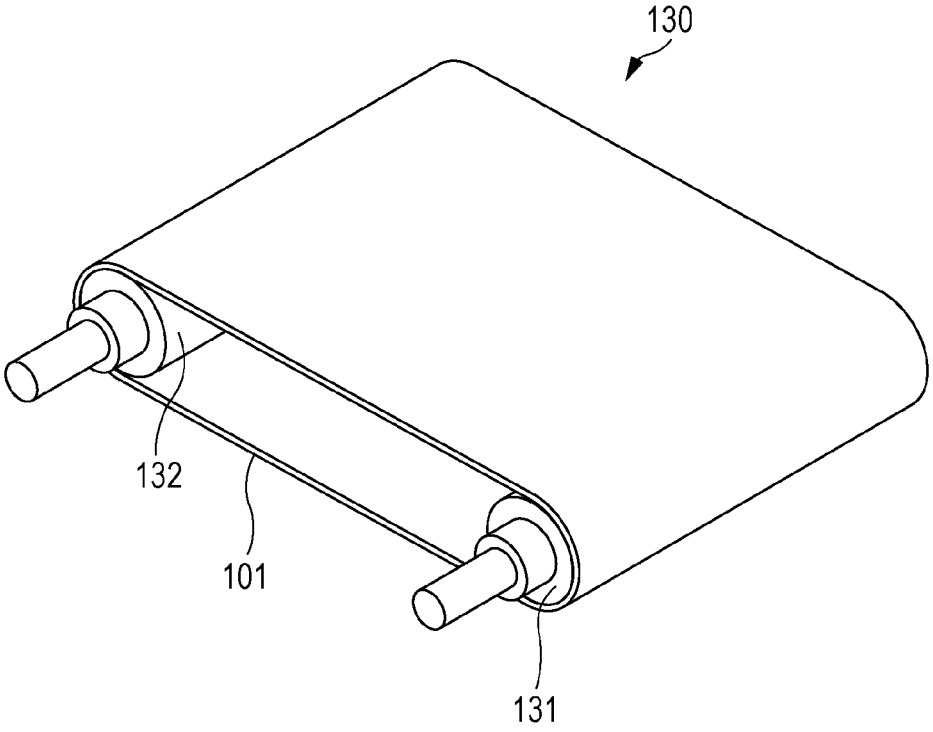
FIG. 2 is a schematic perspective view of an example of a tubular body unit according to the exemplary embodiment.

FIG. 2 is a schematic perspective view of a tubular body unit 130 according to the present exemplary embodiment.

As illustrated in FIG. 2, the tubular body unit 130 according to the present exemplary embodiment includes a tubular body 101 according to the present exemplary embodiment. For example, the tubular body 101 is arranged so as to extend (hereinafter sometimes referred to as "stretched") around a driving roller 131 and a driven roller 132, which oppose each other, with a tension applied to the tubular body 101.

In the tubular body unit 130 according to the present exemplary embodiment, in the case where the tubular body 101 is used as an intermediate transfer body, the tubular body 101 is stretched around rollers including a first transfer roller used to transfer a toner image on a surface of an image carrier (for example, photoconductor) onto the tubular body 101 and a second transfer roller used to transfer the toner image that has been transferred onto the tubular body 101 onto a recording medium. The number of rollers around which the tubular body 101 is stretched is not limited, and a suitable number of rollers may be arranged depending on the use.

The tubular body unit 130 is installed in the image forming apparatus. When the driving roller 131 and the driven roller 132 are rotated, the tubular body 101 stretched around the driving roller 131 and the driven roller 132 is also rotated.

Image Forming Apparatus and Intermediate Transfer Body

The image forming apparatus according to the present exemplary embodiment includes an image carrier; a charging unit that charges a surface of the image carrier; an electrostatic-image forming unit that forms an electrostatic image on the charged surface of the image carrier; a developing unit that develops the electrostatic image on the surface of the image carrier into a toner image by using electrostatic developer containing toner; and a transfer unit that transfers the toner image formed on the surface of the image carrier onto a recording medium. The transfer unit includes the tubular body according to the present exemplary embodiment.

More specifically, the transfer unit of the image forming apparatus according to the present exemplary embodiment includes, for example, an intermediate transfer body onto which the toner image formed on the surface of the image carrier is transferred; a first transfer member that transfers the toner image formed on the surface of the image carrier onto a surface of the intermediate transfer body; and a second transfer member that transfers the toner image that has been transferred onto the surface of the intermediate transfer body onto the recording medium. The tubular body according to the present exemplary embodiment functions as the intermediate transfer body.

The image forming apparatus according to the present exemplary embodiment may be, for example, a monochrome image forming apparatus including a developing device that contains only toner of a single color; a color image forming apparatus in which transferring of a toner image carried by the image carrier onto the intermediate transfer body is repeated; or a tandem color image forming apparatus in which plural image carriers provided with developing devices of respective colors are linearly arranged along the intermediate transfer body.

The image forming apparatus according to the present exemplary embodiment may further include at least one of a fixing unit that fixes the toner image that has been transferred onto the recording medium to the recording medium, a cleaning unit that removes the toner that remains on the surface of the image carrier, and a cleaning unit that removes the toner that remains on the surface of the transfer unit.

Figure 3:
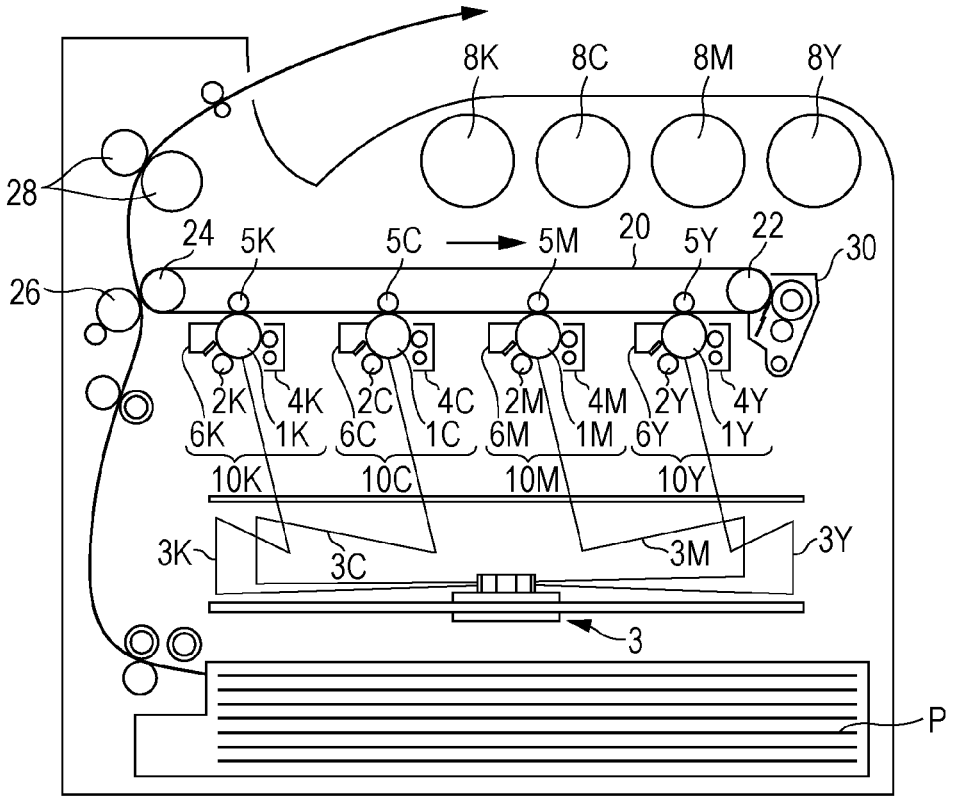
FIG. 3 is a schematic diagram illustrating an example of an image forming apparatus according to the exemplary embodiment.

The image forming apparatus according to the present exemplary embodiment will be described with reference to FIG. 3. FIG. 3 is a schematic diagram illustrating an example of the image forming apparatus according to the present exemplary embodiment.

The image forming apparatus illustrated in FIG. 3 is an intermediate transfer type apparatus that includes a transfer unit including the tubular body according to the present exemplary embodiment as an intermediate transfer body.

The image forming apparatus illustrated in FIG. 3 includes first to fourth electrophotographic image forming units 10Y, 10M, 10C, and 10K (example of image forming devices) that output yellow (Y), magenta (M), cyan (C), and black (K) images based on color-separated image data. The image forming units (hereinafter referred to simply as "units") 10Y, 10M, 10C, and 10K are arranged with spaces therebetween in the horizontal direction. The units 10Y, 10M, 10C, and 10K may be process cartridges that are detachably attachable to an image forming apparatus body.

An intermediate transfer belt 20 (example of an intermediate transfer body) is provided above the units 10Y, 10M, 10C, and 10K in FIG. 3 so as to extend along the units. The intermediate transfer belt 20 is stretched around a driving roller 22 and a back roller 24 that is in contact with the inner surface of the intermediate transfer belt 20. The driving roller 22 and the back roller 24 are arranged in that order from left to right in FIG. 3 with a space therebetween. The intermediate transfer belt 20 is moved in a direction from the first unit 10Y to the fourth unit 10K. The back roller 24 is urged in a direction away from the driving roller 22 by a spring or the like (not shown), so that a tension is applied to the intermediate transfer belt 20 that is stretched around the driving roller 22 and the back roller 24. An intermediate-transfer-body cleaning device 30 is arranged on the outer surface of the intermediate transfer belt 20 so as to face the driving roller 22.

The units 10Y, 10M, 10C, and 10K respectively include developing devices 4Y, 4M, 4C, and 4K (example of developing units) to which yellow, magenta, cyan, and black toners contained in toner cartridges 8Y, 8M, 8C, and 8K are respectively supplied.

The first to fourth units 10Y, 10M, 10C, and 10K have similar structures. Therefore, the first unit 10Y, which is at an upstream position in the direction in which the intermediate transfer belt travels and which forms a yellow image, will be described as an example.

The first unit 10Y includes a photoconductor 1Y (example of an image carrier). A charging roller 2Y (example of a charging unit), an exposure device 3 (example of an exposure unit), a developing device 4Y (example of a developing unit), a first transfer roller 5Y (example of a first transfer unit), and a photoconductor cleaning device 6Y (example of a cleaning unit) are arranged in that order around the photoconductor 1Y. The charging roller 2Y charges a surface of the photoconductor 1Y. The exposure device 3 forms an electrostatic image by irradiating the charged surface with a laser beam 3Y based on a color-separated image signal. The developing device 4Y develops the electrostatic image by supplying toner to the electrostatic image. The first transfer roller 5Y transfers the developed toner image onto the intermediate transfer belt 20. The photoconductor cleaning device 6Y removes the toner that remains on the surface of the photoconductor by after the first transfer process.

The first transfer roller 5Y is disposed on the inner side of the intermediate transfer belt 20 and is arranged so as to face the photoconductor 1Y. The first transfer rollers 5Y, 5M, 5C, and 5K are connected to their respective bias power supplies (not shown) that apply a first transfer bias thereto. Each bias power supply changes the transfer bias applied to the corresponding first transfer roller under the control of a controller (not shown).

An operation of forming a yellow image performed by the first unit 10Y will now be described. First, before the operation is started, the surface of the photoconductor 1Y is charged to a potential in the range of about −600 V to −800 V by the charging roller 2Y.

The photoconductor 1Y is formed by stacking a photosensitive layer on a conductive base (volume resistivity is $1\times10^{-6}$ Ωcm or less at 20° C.). The photosensitive layer normally has a high resistance (resistance close to that of a common resin), but has characteristics such that when a portion of the photosensitive layer is irradiated with the laser beam 3Y, the specific resistance of the irradiated portion changes. The exposure device 3 emits the laser beam 3Y toward the charged surface of the photoconductor 1Y in accordance with yellow image data transmitted from a controller (not shown). The photosensitive layer on the surface of the photoconductor 1Y is irradiated with the laser beam 3Y, and accordingly an electrostatic image is formed on the surface of the photoconductor 1Y.

The electrostatic image is a so-called negative latent image formed when the photosensitive layer is irradiated with the laser beam 3Y so that the charges on the surface of the photoconductor 1Y are released due to a reduction in the specific resistance in regions where the photosensitive layer is irradiated with the laser beam 3Y, and are maintained in regions where the photosensitive layer is not irradiated with the laser beam 3Y.

The photoconductor 1Y is rotated so that the electrostatic image formed on the photoconductor 1Y is moved to a developing position, and the electrostatic image is visualized (developed) by the developing device 4Y at the developing position.

The developing device 4Y stores developer containing at least the yellow toner and carrier. The yellow toner is electrified by friction by being stirred in the developing device 4Y. Accordingly, the yellow toner is charged to the same polarity as that of the charges on the photoconductor 1Y (negative polarity), and is carried by the developing roller (developer carrier). When the surface of the photoconductor 1Y passes the developing device 4Y, the yellow toner electrostatically adheres to the surface of the photoconductor 1Y in latent image regions in which the charges have been removed. Accordingly, the latent image is developed with the yellow toner. The photoconductor 1Y on which the yellow toner image is formed continuously rotates, so that the yellow toner image that has been developed on the photoconductor 1Y is transported to a first transfer position.

When the yellow toner image on the photoconductor 1Y is transported to the first transfer position, the first transfer bias is applied to the first transfer roller 5Y, and an electrostatic force is applied to the toner image in the direction from the photoconductor 1Y toward the first transfer roller 5Y. Accordingly, the toner image on the photoconductor 1Y is transferred onto the intermediate transfer belt 20. At this time, the polarity of the transfer bias (+) is opposite to the polarity of the toner (−), and is adjusted to about +10 μA by a controller (not shown) in the first unit 10Y.

The toner that remains on the photoconductor 1Y is removed and collected by the photoconductor cleaning device 6Y.

The intermediate transfer belt 20 onto which the yellow toner image is transferred in the first unit 10Y is successively transported through the second to fourth units 10M, 10C, and 10K, and the toner images of the respective colors are transferred onto the intermediate transfer belt 20 in a superposed manner. The first transfer biases applied to the first transfer rollers 5M, 5C, and 5K in the second to fourth units 10M, 10C, and 10K are also controlled as in the first unit 10Y.

The intermediate transfer belt 20 onto which the toner images of four colors have been transferred in a superposed manner by the first to fourth units is transported to a second transfer section. The second transfer section includes the intermediate transfer belt 20, the back roller 24 that is in contact with the inner surface of the intermediate transfer belt 20, and a second transfer roller 26 (example of a second transfer member) arranged on the outer surface of the intermediate transfer belt 20.

In the second transfer section, when a recording sheet P (example of a recording medium) is supplied to a gap between the second transfer roller 26 and the intermediate transfer belt 20 that are pressed against each other, a second transfer bias is applied to the back roller 24. The polarity of the second transfer bias (−) is the same as the polarity of the toner (−), so that an electrostatic force is applied to the toner images in the direction from the intermediate transfer belt 20 toward the recording sheet P. Accordingly, the toner images on the intermediate transfer belt 20 are transferred onto the recording sheet P. The second transfer bias is determined based on a resistance detected by a resistance detector (not shown) that detects the resistance of the second transfer section, and is voltage-controlled.

Then, the recording sheet P is transported to a fixing device 28 (example of a fixing unit), and the toner images are heated. Thus, the toner images of different colors that are in a superposed manner are melted and fixed to the recording sheet P. The recording sheet P to which a color image has been fixed is transported to an output section. Thus, a color image forming operation is completed.

The recording sheet P onto which the toner images are transferred may be, for example, a sheet of normal paper used in, for example, an electrophotographic copier or a printer. Instead of the recording sheet P, an OHP sheet or the like may be used as the recording medium.

EXAMPLES

The present invention will now be further described by way of examples. However, the present invention is not limited to the examples.

In the following description, "parts" means parts by mass unless otherwise specified.

Example 1

Manufacture of Resin Pellets

A polyphenylene sulfide (PPS) resin (T1881-3 produced by Toray Industries, Inc.) is fed to a twin-screw melt-kneading extruder (L/D60produced by Parker Corporation) as a thermoplastic resin. Then, 15 parts of carbon black (PRINTEX alpha produced by Orion Engineered Carbons Co., Ltd.) is added to 100 parts of the melted PPS resin as a conducting agent, and is melted and kneaded together with the resin. The melted and kneaded mixture is placed in a water bath so that the mixture is cooled and cured, and is cut so that resin pellets containing carbon black are obtained.

Manufacture of Belt

The resin pellets are fed to a single-screw melt extruder (L/D24 produced by Mitsuba Mfg. Co., Ltd.) and melted at a heating temperature of 330° C. The melted resin is extruded from a space between a die and a nipple set to 300° C., and at the same time the inner surface of the molten resin is brought into contact with the outer surface of a cylindrical inner sizing die so that the resin is cooled and cured. Then, the resin is cut so that a tubular extrusion molded part is obtained. The extrusion molded part is set to a mandrel having grooves in an outer surface thereof, and is cut by pressing a cutting edge against the outer surface of the extrusion molded part at positions corresponding to the grooves in the mandrel. As a result, a belt having a width of 322.1 mm, a peripheral length of 680.5 mm, and an average thickness of 100 μm is obtained.

As a result of visual observation of both edges of the belt after the cutting process, it is confirmed that irregular portions such as projections and steps are present.

Thermal Process of Edges of Belt

Both edges of the belt are placed on a digital hot plate stirrer (OC-420D produced by Corning Incorporated), which is heated to 295° C., for 30 seconds so that the edges are thermally melted over the entire regions thereof in the peripheral direction, and then the belt is put in a room temperature environment (20° C. to 25° C.) so that the edges are cured. Thus, a belt with edges having a bulging shape over the entire regions thereof in the peripheral direction is obtained.

As a result of visual observation of both edges of the belt after the thermal processing, it is confirmed that irregular portions such as projections and steps are not present, and the edges have a smooth, continuous bulging shape over the entire regions thereof in the peripheral direction.

Example 2

A belt is obtained by a process similar to that in Example 1 except that a polyether imide (PEI) resin (Ultem 1000-1000 produced by SABIC) is used as the thermoplastic resin, the heating temperature of the single-screw melt extruder is changed to 370° C., the temperature of the die and nipple is changed to 350° C., and the heating temperature of the digital hot plate stirrer is changed to 370° C.

As a result of visual observation of both edges of the belt after the cutting process, it is confirmed that irregular portions such as projections and steps are present.

As a result of visual observation of both edges of the belt after the thermal processing, it is confirmed that irregular portions such as projections and steps are not present, and the edges have a smooth, continuous bulging shape over the entire regions thereof in the peripheral direction.

Example 3

A belt is obtained by a process similar to that in Example 1 except that a polyether ether ketone (PEEK) resin (Vestakeep 1000G produced by Daicel-Evonik Ltd.) is used as the thermoplastic resin, the heating temperature of the single-screw melt extruder is changed to 390° C., the temperature of the die and nipple is changed to 370° C., and the heating temperature of the digital hot plate stirrer is changed to 390° C.

As a result of visual observation of both edges of the belt after the cutting process, it is confirmed that irregular portions such as projections and steps are present.

As a result of visual observation of both edges of the belt after the thermal processing, it is confirmed that irregular portions such as projections and steps are not present, and the edges have a smooth, continuous bulging shape over the entire regions thereof in the peripheral direction.

Example 4

A belt is obtained by a process similar to that in Example 1 except that the amount of carbon black added to 100 parts of the resin is changed to 35 parts.

As a result of visual observation of both edges of the belt after the cutting process, it is confirmed that irregular portions such as projections and steps are present.

As a result of visual observation of both edges of the belt after the thermal processing, it is confirmed that irregular portions such as projections and steps are not present, and the edges have a smooth, continuous bulging shape over the entire regions thereof in the peripheral direction.

Example 5

A belt is obtained by a cutting process similar to that in Example 1. As a result of visual observation of both edges of the belt after the cutting process, it is confirmed that irregular portions such as projections and steps are present.

The irregular portions, such as projections and steps, on both edges of the belt after the cutting process are pressed against a digital hot plate stirrer, which is heated to 295° C., for 30 seconds so that the irregular portions are thermally melted, and then the belt is put in a room temperature environment (20° C. to 25° C.) so that the melted portions are cured. Thus, the irregular portions, such as projections and steps, are changed to smooth bulging portions, and a belt with edges having no visually discernible irregular portions, such as projections and steps, over the entire regions thereof in the peripheral direction is obtained.

Comparative Examples 1 to 3

Belts are obtained by processes similar to those in Examples 1 to 3 except that the edges of the belts are not subjected to thermal process. In other words, the belts after the cutting process in Examples 1 to 3 serve as Comparative Examples 1 to 3, respectively. The edges of the belts of Comparative Examples 1 to 3 are not subjected to the thermal processing, and therefore do not have a bulging shape.

Comparative Example 4

A belt is obtained by a cutting process similar to that in Example 1. Pieces of resin tape (more specifically, Acetate-based adhesive tape No. 5 produced by Nitto Denko Corporation in which an acrylic adhesive layer is stacked on acetate cloth and which has a width of 10 mm and a thickness of 230 μm) are applied to both end portions of the belt after the cutting process over the entire regions thereof in the peripheral direction. Thus, the end portions are reinforced. The edges of the belt of Comparative Example 4 are not subjected to the thermal processing, and therefore do not have a bulging shape.

Evaluation

The belts of the above-described Examples and Comparative Examples are installed in an image forming apparatus (DocuPrint C3350 produced by Fuji Xerox Co., Ltd.) as an intermediate transfer belt, and an operation of forming images on 50 thousand recording sheets continuously is performed in an environment in which the temperature is 25° C. and a relative humidity is 55%. The end portions of the belts in the axial direction are visually observed and evaluated based on the following criteria. The result of the observation is shown in Table 1.

A: No cracks are found.

B: Small cracks that do not seriously affect the movement of the belt are found.

C: Cracks that seriously affect the movement of the belt are found.

TABLE 1

| | |
|---|---|
| Example 1 | A |
| Example 2 | A |
| Example 3 | A |

TABLE 1-continued

| | |
|---|---|
| Example 4 | B |
| Example 5 | A |
| Comparative Example 1 | C |
| Comparative Example 2 | C |
| Comparative Example 3 | C |
| Comparative Example 4 | A |

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A tubular body for an image forming apparatus, wherein the tubular body is formed by:

subjecting thermoplastic resin to thermal processing;

cooling and curing the thermoplastic resin;

cutting a tubular extrusion molded part from the cooled and cured thermoplastic resin; and thermally melting and curing an edge of the tubular extrusion molded art in a peripheral direction.

2. The tubular body according to claim 1, wherein the edge of the tubular extrusion molded part comprises a portion of the tubular extrusion molded part that connects inner and outer surfaces of the tubular extrusion molded part in a width direction of the tubular extrusion molded part, wherein the width direction of the tubular extrusion molded part is a direction parallel to a direction of a rotational axis of the tubular extrusion molded part around which the tubular extrusion molded part rotates, and wherein the melting and curing comprises melting and curing over an entire region of the edge in the peripheral direction.

3. The tubular body according to claim 2, wherein the tubular extrusion molded part further contains a conducting agent.

4. The tubular body according to claim 1, wherein the tubular exstrusion molded part further contains a conducting agent.

5. A tubular body unit comprising:

the tubular body according to claim 1; and a plurality of rollers around which the tubular body extends providing a tension applied to the tubular body, wherein the tubular body unit is attachable to and detachable from the image forming apparatus.

6. An intermediate transfer body comprising:

the tubular body according to claim 1.

7. An image forming apparatus comprising:

an image carrier;

a charging unit that charges a surface of the image carrier;

an electrostatic-image forming unit that forms an electrostatic image on the charged surface of the image carrier;

a developing unit that develops the electrostatic image formed on the surface of the image carrier into a toner image by using electrostatic developer containing toner;

an intermediate transfer body onto which the toner image formed on the surface of the image carrier is transferred and which includes the tubular body according to claim 1;

a first transfer unit that transfers the toner image formed on the surface of the image carrier onto a surface of the intermediate transfer body; and a second transfer unit that transfers the toner image that has been transferred onto the surface of the intermediate transfer body onto a recording medium.

8. A tubular body for an image forming apparatus, comprising:

a thermoplastic resin, wherein at least one edge of the tubular body has a bulging shape of an arc length extending from an inner surface of the tubular body to an outer surface of the tubular body at least in a portion of the edge in a peripheral direction.

9. The tubular body according to claim 8, wherein the at least one edge comprises both edges of the tubular body have the bulging shape over entire regions of both edges in the peripheral direction.

10. The tubular body according to claim 9, further comprising a conducting agent.

11. The tubular body according to claim 8, further comprising a conducting agent.

12. A tubular body unit comprising:

the tubular body according to claim 8; and a plurality of rollers around which the tubular body extends providing a tension applied to the tubular body, wherein the tubular body unit is attachable to and detachable from the image forming apparatus.

13. An intermediate transfer body comprising:

the tubular body according to claim 8.

14. An image forming apparatus comprising:

an image carrier;

a charging unit that charges a surface of the image carrier;

an electrostatic-image forming unit that forms an electrostatic image on the charged surface of the image carrier;

a developing unit that develops the electrostatic image formed on the surface of the image carrier into a toner image by using electrostatic developer containing toner;

an intermediate transfer body onto which the toner image formed on the surface of the image carrier is transferred and which includes the tubular body according to claim 5;

a first transfer unit that transfers the toner image formed on the surface of the image carrier onto a surface of the intermediate transfer body; and a second transfer unit that transfers the toner image that has been transferred onto the surface of the intermediate transfer body onto a recording medium.

15. A method for manufacturing a tubular body for an image forming apparatus, the method comprising:

subjecting a thermoplastic resin to thermal processing;

cooling and curing the thermoplastic resin;

cutting a tubular extrusion molded part from the cooled and cured thermoplastic resin; and thermally melting and curing an edge of the tubular extrusion molded part in a peripheral direction.

* * * * *